US006922962B2

(12) United States Patent
Schmidt

(10) Patent No.: US 6,922,962 B2
(45) Date of Patent: Aug. 2, 2005

(54) MODIFIED FLAT WALL MODULAR INSULATED CONCRETE FORM SYSTEM

(76) Inventor: Donald L. Schmidt, 425 Second Ave., SW., Oronoco, MN (US) 55960

( * ) Notice: Subject to any disclaimer, the term of this patent is extended or adjusted under 35 U.S.C. 154(b) by 181 days.

(21) Appl. No.: 09/932,081

(22) Filed: Aug. 20, 2001

(65) Prior Publication Data

US 2003/0033781 A1 Feb. 20, 2003

(51) Int. Cl.[7] ..... E04B 2/00

(52) U.S. Cl. ..... 52/426; 52/425; 52/424; 52/276; 52/279; 52/309.15; 52/309.17

(58) Field of Search ..... 52/426, 425, 424, 52/276, 279, 309.15, 309.17

(56) References Cited

U.S. PATENT DOCUMENTS

| | | | | | |
|---|---|---|---|---|---|
| 4,577,447 | A | * | 3/1986 | Doran | 52/571 |
| 4,860,515 | A | * | 8/1989 | Browning, Jr. | 52/422 |
| 4,884,382 | A | * | 12/1989 | Horobin | 52/426 |
| 5,566,518 | A | * | 10/1996 | Martin et al. | 52/309.17 |
| 5,709,060 | A | * | 1/1998 | Vaughan et al. | 52/426 |
| 6,321,497 | B1 | * | 11/2001 | Cormier | 52/425 |
| 6,526,713 | B2 | * | 3/2003 | Moore, Jr. | 52/309.11 |

OTHER PUBLICATIONS

"Insulating Concrete Forms: Comfort And Security In An Easy–To–Use Package", published by the Insulating Concrete Form Association, Glenview, Illinois.

* cited by examiner

*Primary Examiner*—Carl D. Friedman
*Assistant Examiner*—Steve Varner
(74) *Attorney, Agent, or Firm*—Siemens Patent Services, LC

(57) ABSTRACT

Improved, modified flat wall insulating concrete forms similar to a "waffle grid" type for generating posts, beams, and interconnecting webs of concrete. The novel forms incorporate interlocking structure for a plural vertically stacked forms. The forms are provided as angled corner or straight forms having an overall length of four feet. Tie brackets connecting interior and exterior synthetic expanded foam walls of the form have flanges which are embedded within and concealed by the walls. Tie brackets are spaced apart from one another at one foot intervals, and from ends of the interior and exterior walls of the form by distance intervals of six inches. Interior and exterior walls are configured to enclose a void space therebetween. When filled with concrete, the space forms posts, beams, and webs filling openings which would otherwise occur among the posts and beams. The posts and beams, and webs are square or rectangular in cross section, presenting a uniform exterior panel thickness.

16 Claims, 5 Drawing Sheets

MODIFIED FLAT WALL MODULAR INSULATED CONCRETE FORM SYSTEM

This application is related to application Ser. No. 09/932,095 entitled CORNER FORM FOR A MODULAR INSULATING CONCRETE FORM SYSTEM and Ser. No. 09/932,096 entitled FORM BRACING TIE BRACKET FOR MODULAR INSULATING CONCRETE FORM SYSTEM AND FORM USING THE SAME, filed concurrently herewith on Aug. 20, 2000.

BACKGROUND OF THE INVENTION

1. Field of the Invention

The present invention relates to modular insulating concrete forms of the type which receive poured concrete and are abandoned in place after pouring, thereby becoming an integral part of a static structure being built. The invention is particularly applicable to residential and light commercial construction. The novel forms are usable by homeowners, contractors, municipal, industrial, and institutional personnel in building and improving existing structures wherever insulated load bearing walls are to be built from poured concrete.

2. Description of the Prior Art

Left-in-place insulting concrete forms for building foundations and load bearing walls from poured concrete are known. In commercial practice, courses of forms are stacked until the final desired height of a wall is attained. Concrete is poured into the erected forms and allowed to cure. The resultant wall must provide both strength and also insulation protection against the elements. Insulating concrete forms have been proposed to answer these needs. In order to maximize both strength and insulation values within a given volume dedicated to a left-in-place form wall, the concrete elements must be carefully designed to utilize a minimum amount of concrete, so that the balance of the available volume may be filled with the insulating form.

One of the more common designs is the so-called "waffle grid" type. The waffle grid design takes its name from the visual impression of the internal surfaces of its constituent form walls. Intersecting posts and beams formed after pouring of concrete, which would otherwise leave openings, are complemented by webs which close these openings. The webs are considerably thinner than the posts and beams. The overall visual effect is similar to that of typical waffle irons. Waffle grid walls, as well as all insulating concrete form walls, must address several needs.

One is that it is necessary that each form be properly aligned with respect to adjacent forms to assure that finished wall surfaces are flat and flush. Also, opposing exterior panels of each form section must be held in place without distortion of overall configuration of the finished wall.

A second problem of prior art forms is that they are not designed such that locations of tie brackets coincide with the ends of standard building elements. Illustratively, sheets of plywood and gypsum wall board are typically provided with length of eight feet and height of four feet. If a form section has tie brackets and associated plates or flanges serving as a structural members which can receive driven and threaded fasteners, and these plates or flanges are located at each end of the form section, then abutment of two form sections results in abutting plates or flanges. This arrangement will likely interfere with even spacing apart of tie brackets at even distance intervals of a whole number of feet since the two abutting end brackets will be spaced on either side of the center line. Thus, if a fastener is driven at the point of abutment, there will be no solid structural member to receive the fastener.

This makes it difficult to properly locate fastener positions for attaching building elements to the form. Flange location can be calculated, but calculation entails additional effort when constructing forms.

Another problem is that the prior art has not provided insulating concrete form walls which are conducive to laying a wall in increments of one foot, as measured from the outside corner, as is frequent construction practice. Prior art forms typically require shortening by cutting to accommodate building walls laid out in increments of one foot.

A representative waffle grid design and a representative post and beam design are illustrated in a color brochure entitled "Insulating Concrete Forms: Comfort And Security In An Easy-To-Use Package" (undated), published by the Insulating Concrete Form Association, Glenview, Ill. 60025.

Another problem of existing waffle grid insulating concrete forms is that none known to the present inventor has means for interlocking with forms of courses above and below. The prior art fails to describe the instant invention as claimed.

SUMMARY OF THE INVENTION

The present invention provides insulating concrete forms which provide the best features of both the "flat wall" and the "waffle grid" type forms which satisfy two practical needs. One need is that of forms which can be erected in interlocked stacks which oppose sliding and disengagement of one form with both its vertical and horizontal neighbors. The other need is to provide forms which favor current U.S. building practices with regard to dimensions. It is frequently the case that buildings are designed in increments of one foot and even in increments of four feet. The novel forms satisfy both needs.

Interlocking is achieved by forming male interlocking members in the top surface of each form, and corresponding female interlocking members in the bottom surface of each form. The male and female interlocks are vertically aligned so that a stack of forms will enable each form to interlock with a form placed directly thereon and also with the form located directly below.

The forms are configured such that pouring concrete into the void formed between the inner and outer opposing walls of insulating material generates a modified flat wall configuration having a substantially flat surface with vertical posts and horizontal beams at regular intervals.

Preferably, the posts and beams are configured as parallelepipeds so that all constituent material thereof contributes to compressive strength in at least one direction of an orthogonal or Cartesian system. No concrete is thus ineffectually used. Overall building costs and weight are minimized, while still affording maximal strength. Also, volume within the form devoted to insulating material is maximized, thereby maximizing temperature insulating value of the form.

Forms may be either straight or angled, the latter being known as corner forms because angled forms are usually used to form the corner of intersecting walls. Both straight and corner forms are dimensioned with regard to modular building. That is, the length of a straight form is preferably four feet. A corner form has combined length of both legs of four feet. These dimensions favor building designs laid out in increments of one, two, and four feet. This characteristic minimizes the number of forms which must be cut in length to achieve a desired wall length, thereby saving labor and tending to promote straightness and integrity of the finished poured wall.

Similarly, tie brackets connecting inner and outer walls of each form section are located at one foot intervals, the first being one half foot from the end of the form. This location prevents tie brackets of adjacent abutting forms in one course from interfering with regular spacing of the tie brackets along the entire length of the wall. Rather, tie bracket spacing remains constant. As a consequence, location of concealed flanges or plates of each tie bracket, which is employed to receive and support driven fasteners for fixing plywood and dry wall sections to the wall, is predictable. Effort and expense of mounting either interior or exterior finishing materials on the finished concrete wall is minimized.

Interlocking members of the form are spaced apart and dimensioned so that clogging with concrete is not a problem. If notches, or female interlocking members, were too small, it would be difficult to dislodge concrete overflow and other materials therefrom. They are spaced apart so that an inordinate number of notches which would otherwise require cleaning is avoided.

Accordingly, it is one object of the invention to provide insulating concrete forms which readily interlock when vertically stacked.

It is another object of the invention that the novel forms facilitate construction of building designs laid out in increments of one, two, and four feet, as measured from the outside corner of the form system.

It is a further object of the invention to minimize labor required to erect the forms.

Still another object of the invention is to enable ready location of concealed tie bracket flanges or plates when driving fasteners into the wall built by the novel forms.

An additional object of the invention is to maximize strength of the wall for the amount of concrete consumed.

It is again an object of the invention to maximize insulation value of the wall.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
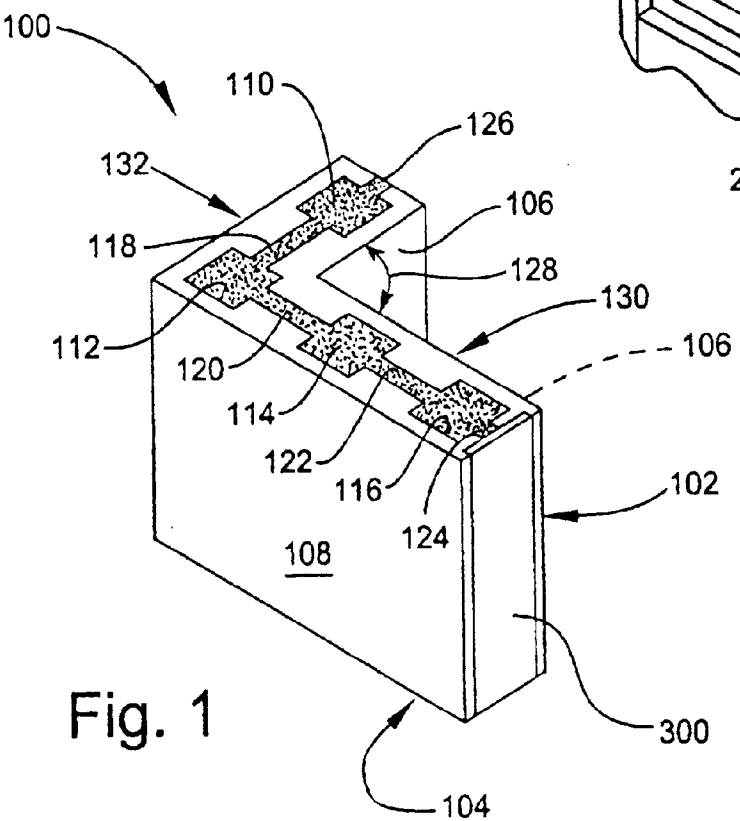
FIG. 1 is a diagrammatic, isometric view of one embodiment of the invention.
Figure 2:
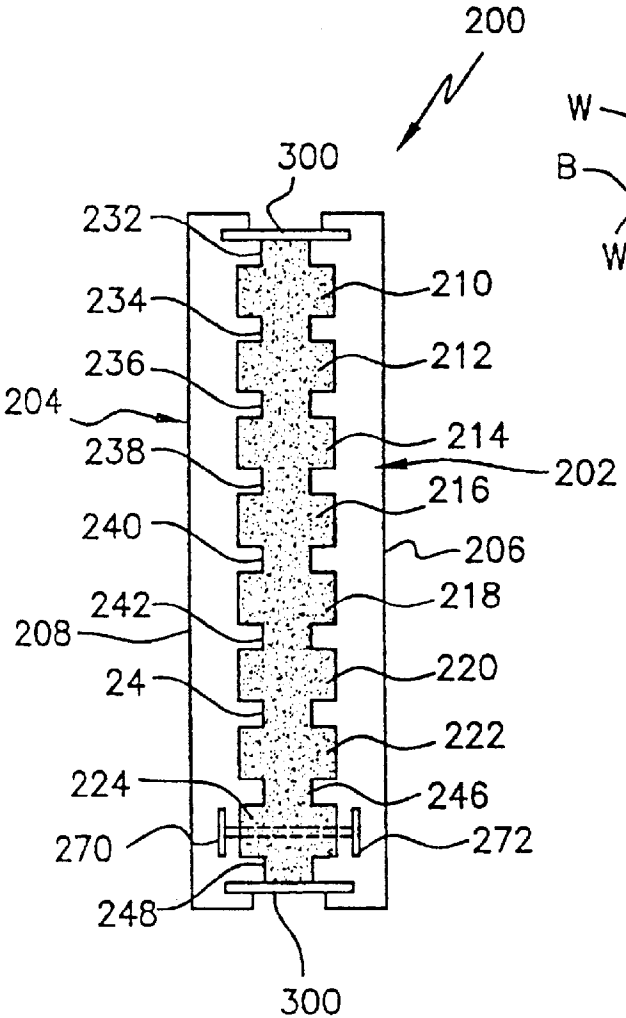
FIG. 2 is a diagrammatic top plan view of a second embodiment of the invention, drawn to scale greater than that of FIG. 1.
Figure 8:
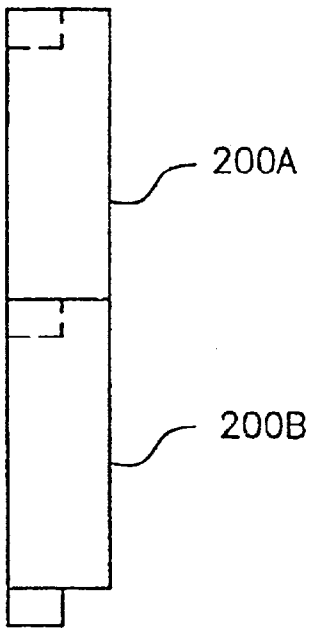
FIG. 8 is an end elevational view of FIG. 7.

The present invention provides improved insulating concrete forms for receiving poured concrete to form an insulated structural wall of a building (not shown). A corner form 100 is depicted in FIG. 1. A preferred configuration is more particularly set forth in my co-pending patent application Ser. No. 09/932,096, filed on Aug. 20, 2001. A corresponding straight form 200 is shown in FIG. 2. Buildings having conventional rectangular floor plan features may be constructed employing both forms 100, 200. Referring to FIGS. 1 and 2, insulating concrete form 100 includes a first insulating panel 102 and a second insulating panel 104. Panels 102, 104 are preferably formed from expanded polystyrene or other synthetic resin closed cell foam. Each panel 102 or 104 has an interior surface concealed from view in FIG. 1, wherein form 100 is shown filled with concrete (indicated by stippling) for clarity of the view. Each panel 102 or 104 has a flat exterior surface (106 or 108, respectively). Concrete form 200 includes a first insulating panel 202 and a second insulating panel 204, both formed from expanded polystyrene closed cell foam. Panels 202, 204 have respective flat exterior surfaces 206, 208. Form 100 differs from form 200 in that whereas form 200 is a straight form, form 100 incorporates an angle 128 formed between leg 130 and leg 132.

The interior surfaces of panels 102, 104 and of 202, 204 face one another and leave a void space between each pair of panels 102, 104 and 202, 204. In both forms 100, 200, the interior surfaces are dimensioned and configured collectively such that a plurality of spaced apart posts 110, 112, 114, 116 and 210, 212, 214, 216, 218, 220, 222, 224 and a plurality of spaced apart beams intersecting posts 110 . . . 116 and 210 . . . 224 are formed. Beams 226, 228, 230 of form 200 are shown in the sectional view of FIG. 3. Corresponding beams of form 100 (not visible in FIG. 1) exist and are similar to those of form 200.

Figure 3:
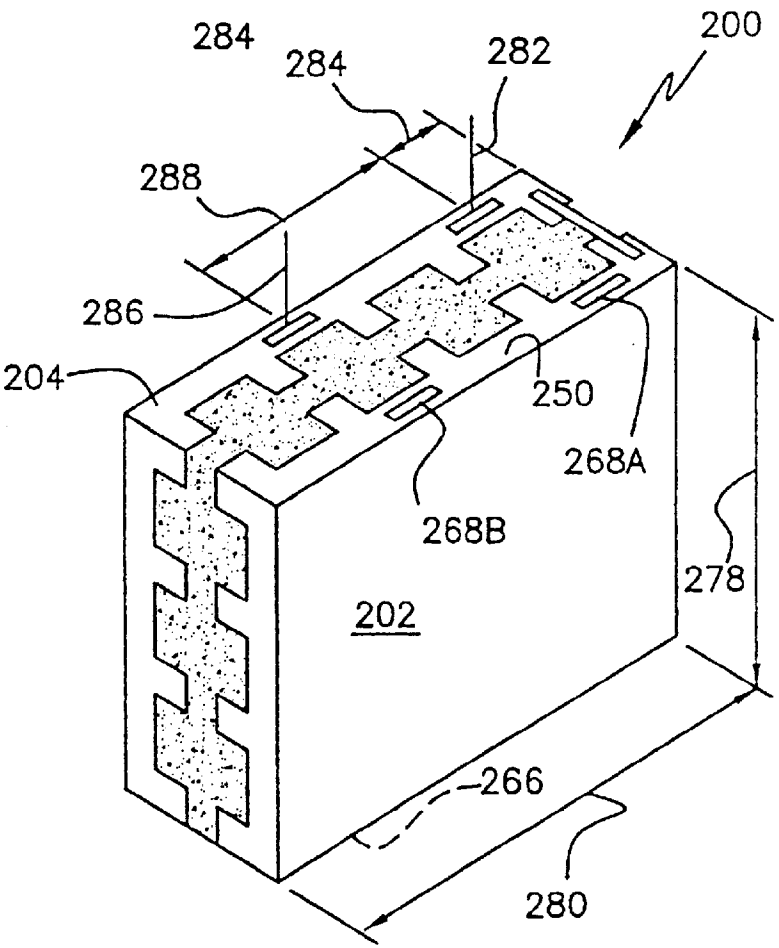
FIG. 3 is an isometric detail view of FIG. 2.
Figure 4:
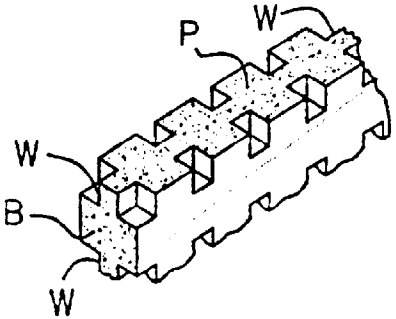
FIG. 4 is an isometric detail view of a concrete core typical of those formed in FIGS. 1 and 2.

In addition to posts and beams, the void forms webs 118, 120, 122, 124, 126 (see FIG. 1) and 232, 234, 236, 238, 240 (see FIG. 2) which span and join corresponding adjacent posts and beams, thereby closing square and rectangular openings (not shown) which would otherwise be formed among the intersecting posts and beams. A series of substantially rectilinear male forming projections 24 (see FIG. 2) on the interior walls of insulating panel 202 and 204, of form 200, protrude from the panels to thereby form the parallelepiped webs (FIG. 4) which span and join corresponding adjacent posts and beams of the modified flat wall. FIG. 4 depicts a section of a cured modified flat wall concrete core of a finished wall. The section of the concrete core is typical of that which would be formed in a section of both forms 100, 200. The nature of posts P, beams B, and webs W is clearly seen in FIG. 4. The void and hence the finished concrete core are dimensioned and configured that posts, beams, and webs of the core are parallelepipeds joined where the posts and beams and webs intersect one another. It will further be seen from FIGS. 1, 2, and 3 that the posts and beams have exterior surfaces disposed only parallel and perpendicular to the longitudinal axis of their associated insulating panels.

Figure 5:
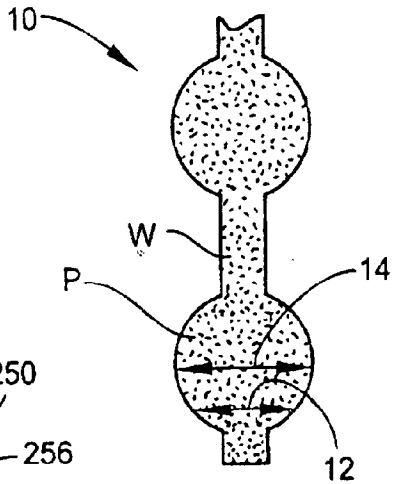
Fig. 5 Prior Art
FIG. 5 is a top plan detail view of a prior art concrete core corresponding to that of FIG. 4.

These characteristics maximize effectiveness of both concrete and of expanded foam. Configuration of posts, beams, and webs maximizes their strength, particularly in the width of each form, where width refers to the dimension between exterior surfaces (e.g., 206, 208 in FIG. 2) of opposing insulating panels. This is better understood by considering a representative prior art concrete core 10 shown in FIG. 5. Ovoid cross section of posts P in the prior art core has the consequence that the dimension indicated by arrow 12 contributes less than that indicated by arrow 14 to strength of post P in a direction parallel to arrows 12, 14. By contrast, posts and beams in the present invention offer maximal magnitude between opposing exterior surfaces along the entire extent of those opposing exterior surfaces. This is the equivalent in the present invention of all dimensions corresponding to arrows 12, 14 of FIG. 4 being of the greater magnitude of arrow 14. Concrete forming that part of post P of FIG. 5 is of reduced effectiveness in contributing to compressive strength, and hence is partially wasted. In the present invention, all of the concrete of the core contributes maximally to compressive strength. Configuration of posts, beams, and webs results in consumption of approximately ninety-eight percent of the concrete employed to form the configuration of the prior art design of FIG. 5, where overall dimensions are similar, while equalling or surpassing compressive strength of the prior art design of FIG. 5. It follows that the volume of the expanded foam of the insulating panels is also maximized in that no partially wasted concrete comparable to that at the location of arrow 12 of FIG. 5 exists in the present invention to serve as a heat conductor which would reduce thermal insulation performance of the finished wall.

Figure 6:
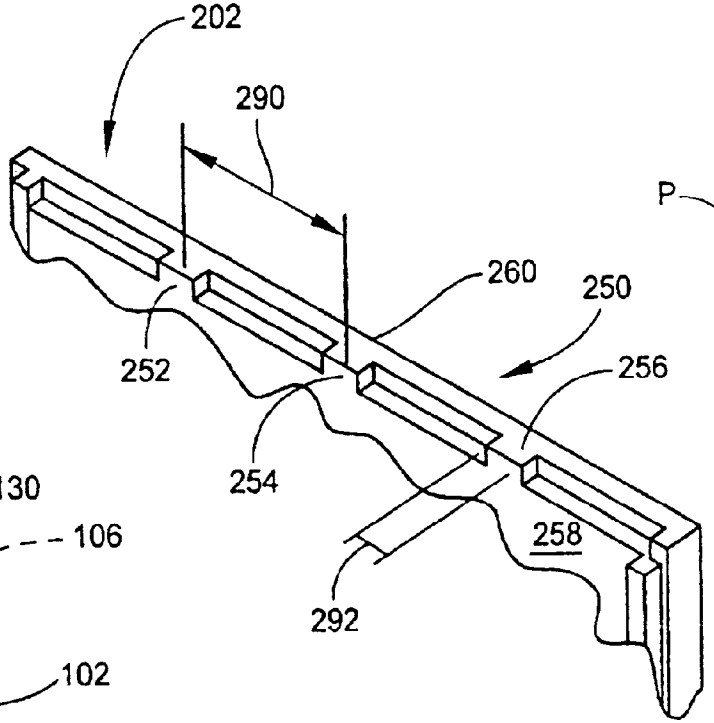
FIG. 6 is an enlarged perspective detail view of the upper left of FIG. 3.

Walls of a building are usually constructed by arranging insulating concrete forms in vertically stacked succeeding courses. When this practice is adopted, it is necessary to assure that the forms not slide horizontally or otherwise be displaced from direct vertical alignment. To this end, forms 100, 200 include interlocking members disposed to oppose parallel movement of one form with respect to a second form disposed in stacked, interlocked relationship. Interlocking structure is shown in FIG. 6, which is explained with reference to form 200, but which will be understood to also be representative of form 100. FIG. 6 shows that upper surface 250 of insulating panel 202 has five projections 251, 252, 254, 256 and 257 formed along interior surface 258 of panel 202. Although projections 251, 252, 254, 256 and 257 could if desired project above surrounding portions of upper surface 250, it is preferred to recess projections 251, 252, 254, 256 and 257 such that their uppermost surfaces be flush with that of a rail 260 formed along the entire length of panel 202. This feature both protects projections 251, 252, 254, 256 and 257 from damage and also minimizes overall height of form 200 for storage, packaging, and transport.

Figure 7:
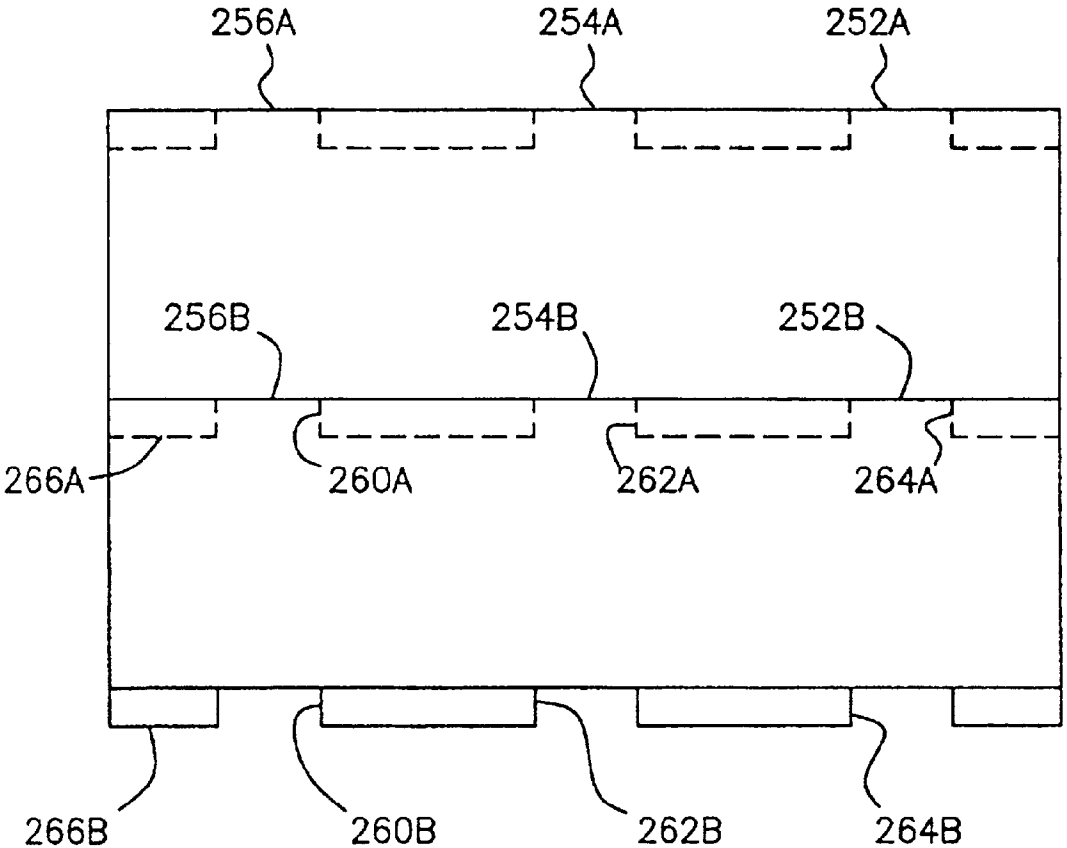
FIG. 7 is an exaggerated, diagrammatic, side elevational detail view of FIG. 3.

Projections 251, 252, 254, 256 and 257 provide male interlocking members which mate with corresponding female interlocking members of a form placed above. This is depicted in FIG. 7, wherein two similar straight forms 200A, 200B are in stacked vertical relation. It will be seen that for each projection 252A, 254A, 256A, form 200A has a corresponding notch 260A, 262A, 264A formed in lower surface 266A (more clearly seen by examining corresponding lower surface 266B of form 200B) directly below in vertical alignment therewith. Notches 260A, 262A, 264A are female interlocking members dimensioned and configured to receive a corresponding one male interlocking member in close cooperation therewith, thereby prohibiting lateral slippage of the forms 100 and 200. The projection 251, 257 at each of the two ends of form 100 and 200 are one half the length of the intermediate projections, allowing the end projection of two abutting forms 100 or 200 to occupy the same notch of form 100 or 200 above.

Figure 9:
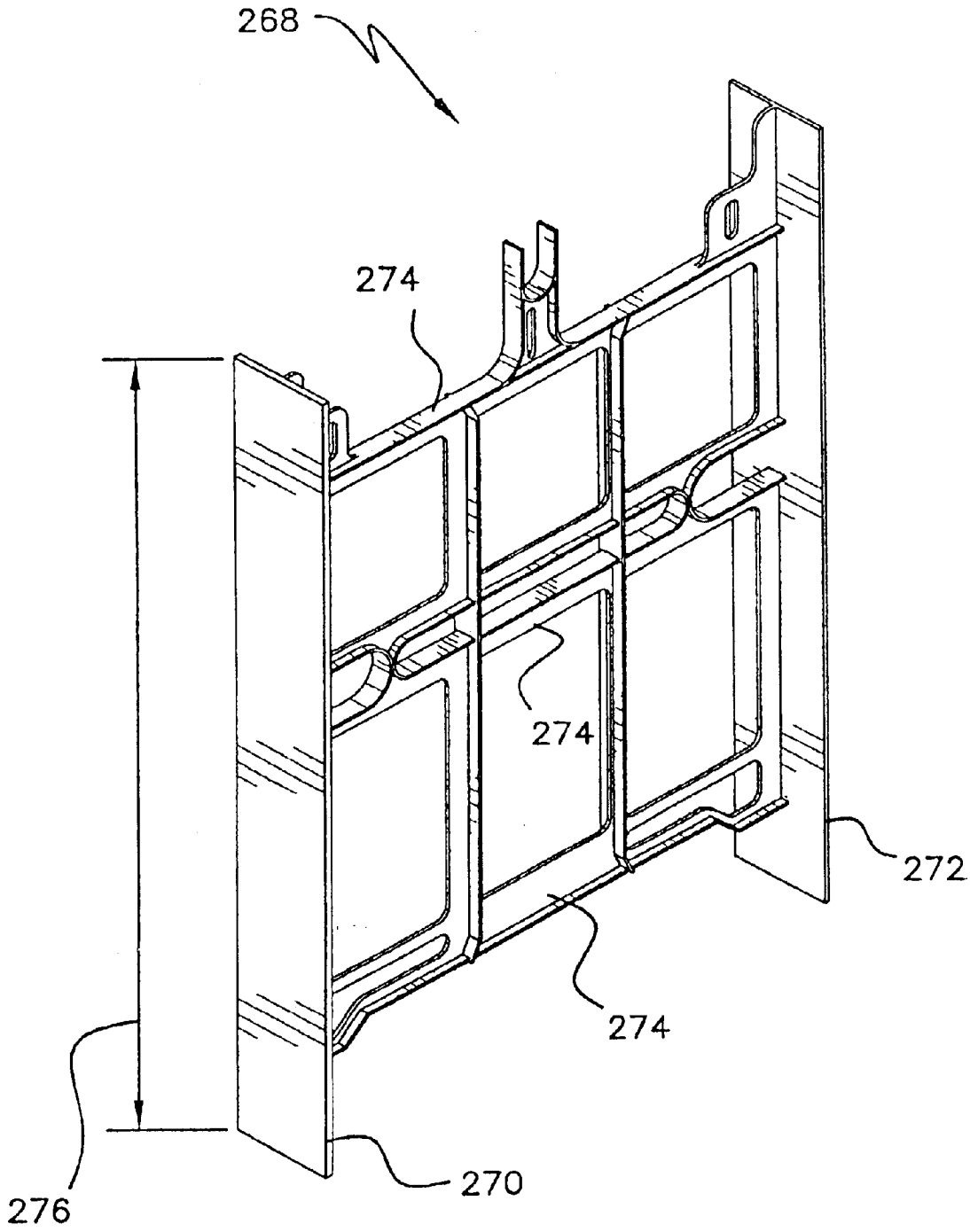
FIG. 9 is a perspective detail view of an internal component of FIG. 3.

Thus far, forms 100, 200 have been described only in terms of respective spaced apart insulating panels 102, 104 and 202, 204. It is preferred to provide each of forms 100, 200 as a united assembly. A tie bracket 268 shown in FIG. 9 spans and connects insulating panels 102, 104 and 202, 204. Tie bracket 268 may assume many possible designs and configurations, and is shown in its depicted form only as a representation of any desired design or configuration. A preferred configuration is more particularly set forth in my co-pending patent application Ser. No. 09/932,095, filed on Aug. 20, 2001. Each form 200 is closed at its proximal and distal ends by an optional separate bulkhead 300 (see FIG. 2). Bulkheads 300 are plates which slidably interfit with grooves formed at the ends of form 200. Bulkheads 300 are used to terminate an insulated poured wall to accommodate interruptions such as doorways, windows, beam pockets and the like. Bulkheads 300 are omitted where two adjacent forms abut so that the resulting concrete core will be continuous and unbroken.

Regardless of its actual configuration, tie bracket 268 includes a first plate or flange 270, a spaced apart parallel plate or flange 272, and spanning elements 274 which hold flanges 270, 272 in spaced apart, parallel relation. When form 200 is fabricated, one flange 270 or 272 of each tie bracket 268 is embedded within panel 202 and the other flange 272 or 270 is embedded within panel 204. Preferably, as shown in FIG. 3, a plurality of tie brackets 268 are employed to connect panels 202, 204.

Tie brackets are vertically longitudinally arranged within form 200. Flanges 270, 272 of tie brackets 268 have a height (see arrow 276 in FIG. 9) equal to that of each insulating panel 202 or 204. Panel height is indicated by arrow 278 in FIG. 3.

One of the important attributes of the present invention is that dimensions of forms 100, 200 facilitate construction of buildings incorporating internal or partial dimensions, such as room length and width of intervals of whole numbers of feet, and of building elements such as prefabricated sheets of plywood and plasterboard having overall dimensions of four and eight feet. To this end, the overall length of form 200, indicated by arrow 280 in FIG. 3, is four feet. Form 100 also accommodates intervals of four feet. First and second insulating panels 102, 104 are formed so that the overall length of leg 130 (see FIG. 1) and the overall length of leg 132 (see FIG. 1) when combined have a sum total length of four feet. Preferably, length of longer leg 130 is eighteen inches, and length of shorter leg 132 is thirty inches.

Location of tie brackets 268 within forms 100 and 200 also favors building dimension intervals of whole numbers of feet and of modules of four and eight feet. As shown in FIG. 3, tie bracket 268A, which is adjacent to the proximal end of insulating panels 202, 204 of form 200, is arranged so that vertical center line 282 of one flange is spaced apart from the proximal end of panels 202, 204 by a distance interval which is greater than two inches and less than one foot. Preferably, this distance interval, indicated by arrow 284, is half a foot, or six inches, thereby maintaining a distance interval of one foot between adjacent tie brackets. If form 200 were scaled up, then the interval indicated by arrow 284 would preferably remain at a measurement of one half foot and the interval indicated by 288 would preferably be a whole number multiple of measurements of one foot.

The distance from the vertical center line 282 of one tie bracket 268 to the vertical center line 286, indicated by arrow 288, is a whole number multiple of measurements of one foot, and in forms 100, 200 intended for most residential applications will be exactly one foot.

Referring now to FIGS. 6 and 7, each interlocking member 252 . . . 258 and corresponding female members are spaced apart from adjacent members by a distance of one foot from center to center of each adjacent said interlocking member, as indicated by arrow 290. Overall length of each interlocking member, indicated by arrow 292, is greater in length than one inch, and is preferably two inches.

It should be understood that individual structural features described with reference to form 200 apply equally to form 100. Forms 100, 200 may be modified or varied from the embodiments described above without departing from the inventive concept. For example, relative positions of female and male interlocking members may be reversed.

Figure 10:
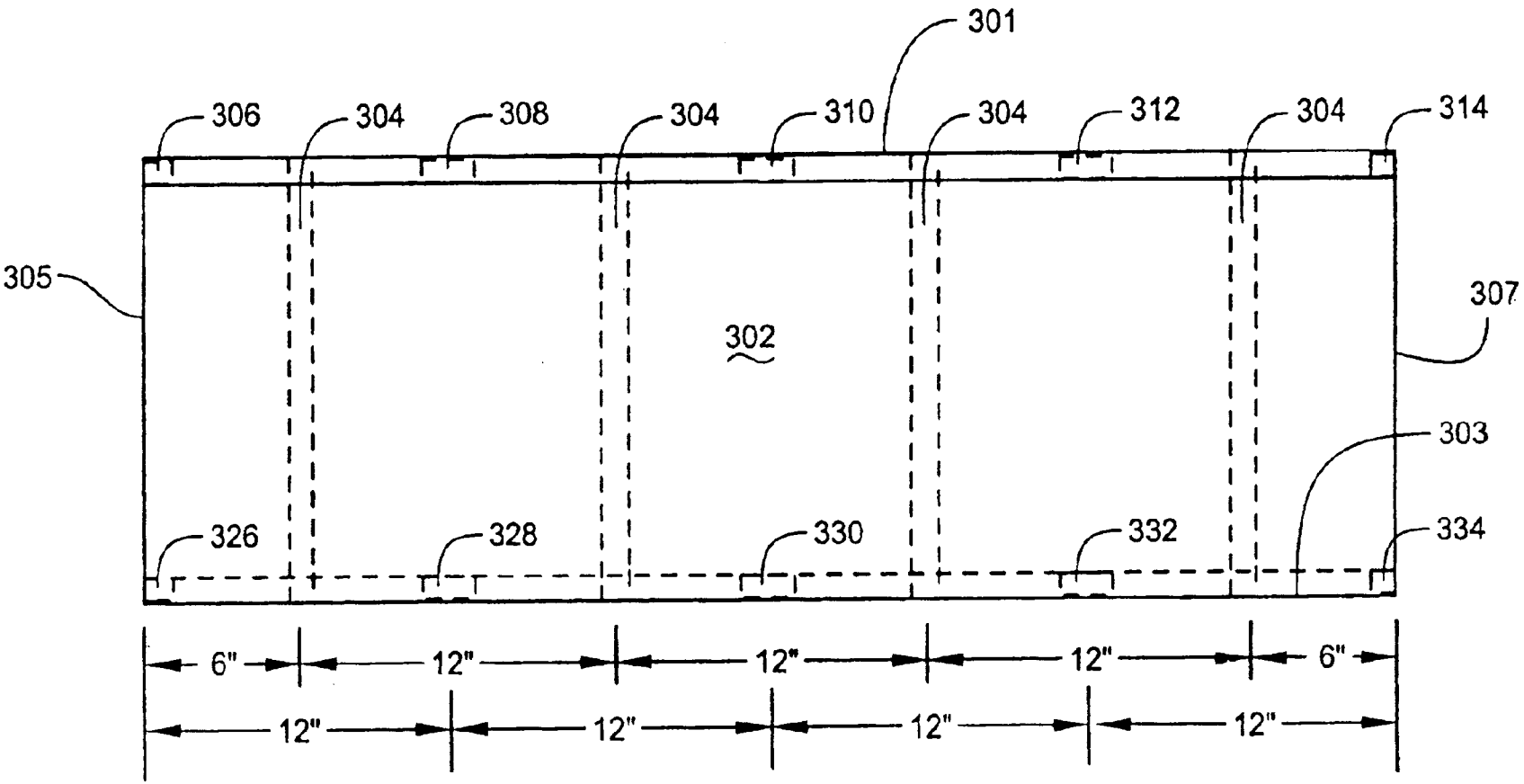
FIG. 10 is a side view of a concrete form system according to the invention.

Referring now to FIG. 10, a side view an embodiment of the concrete form system of the invention is shown, with details of the interior of the system shown using hidden lines. Insulating panel 302, which is typically four feet long, has a series of projections (306, 308, 310, 312, 314) located at its upper surface (301), a series of notches (326, 328, 330, 332, 334) located at its lower surface (303), and a series of tie bracket end flanges (304) positioned intermittently along the length of and extending the full height of insulating panel 302. It can be seen that the tie brackets are positioned with an imaginary vertical center line of each tie bracket end flange 304 located at one foot intervals from one another, with the first and last tie brackets of the system positioned six inches from the respective side surfaces (305, 307) of the insulating panel 302. As previously discussed, this positioning of the tie brackets allows consistent and regular spacing of the tie brackets at one foot intervals along the finished wall, with no inconsistency in tie bracket spacing when passing from one form to an adjacent form in the finished wall. This consistency allows someone using the concrete form system to know with confidence the location of each tie bracket flange in the finished wall, in spite of the fact that the flange is embedded in the concrete and cannot be seen. The location of the projections (306, 308, 310, 312, 314) and corresponding notches (326, 328, 330, 332, 334) are also spaced at intervals of one foot, with the projections (306, 314) and notches (326, 334) positioned adjacent side surfaces (305, 307) of insulating panel 302 being half the size of the projections (308, 310, 312) and notches (328, 330, 332) positioned intermediate the side surfaces of the insulating panel. By making the projections and notches located at the end of the panel half size, the "end" projections of two abutting forms are able to occupy the same full size notch or projection, respectively, of a form located above or below. By positioning the projections and notches at the midway point between the tie brackets, it is ensured that the interlocking projections and notches do not interfere with the tie brackets, and vice versa.

Although only straight and corner forms are depicted and described herein, it would be possible to employ the inventive concept in other configurations. For example, embodiments of the invention could include curved forms (not shown) and forms having more than one angle and two legs (not shown), or any combination of these characteristics.

It is to be understood that the present invention is not limited to the embodiments described above, but encompasses any and all embodiments within the scope of the following claims.

I claim:

1. An insulating concrete form for receiving poured concrete, comprising:

a first insulating panel formed from expanded foam, having a first interior surface, an upper surface, a lower surface, a proximal end, and a distal end;

a second insulating panel formed from expanded foam, having a second interior surface facing said first interior surface of said first insulating panel, an upper surface, a lower surface, a proximal end, and a distal end; and at least one tie bracket spanning, connecting, and spacing apart said first insulating panel and said second insulating panel, wherein said first interior surface and said second interior surface have principally flat surfaces comprising a series of male extensions protruding therefrom collectively to thereby form a void between said first interior surface and a void between opposing extensions of the first and second panels and said second interior surface such that a plurality of spaced apart posts, a plurality of spaced apart beams disposed to intersect said posts, and a plurality of webs spanning and joining adjacent said posts and adjacent said beams are formed when said void is filled with poured concrete and the concrete cures, and wherein said upper surface of said first insulating panel has a first interlocking member formed therein and said lower surface of said first insulating panel has a second interlocking member formed therein, wherein said first interlocking member and said second interlocking member are disposed to oppose parallel movement of one said insulating concrete form with respect to a second said insulating concrete form disposed in stacked, interlocked relationship therewith.

2. The insulating concrete form according to claim 1, wherein the series of protrusions of said first and second interior surfaces are substantially rectilinear and face one another in an opposing manner such that said posts and said beams are parallelepiped joined where said posts and said beams intersect one another; and wherein said posts have exterior surfaces disposed perpendicular to said first insulating panel and said second insulating panel, and said beams have exterior surfaces disposed parallel to said first insulating panel and said second insulating panel.

3. The insulating concrete form according to claim 2, wherein said first interlocking member is a male interlocking member and said second interlocking member is a female interlocking member, wherein each said female interlocking member is dimensioned and configured to receive one said male interlocking member in close cooperation therewith, and each said female interlocking member is located in vertical alignment with one said male interlocking member; and wherein the upper surface of said first and second insulating panels have a series of male projections formed along the interior surfaces of said first male interlocking member, and the lower surface of said first and second insulating panels have a series of corresponding female notches formed therein for mating coupling between said male projections and said female notches for vertical alignment between said concrete forms to prohibit horizontal and vertical displacement and ensure vertical alignment of successive tie brackets during vertical alignment of said forms.

4. The insulating concrete form according to claim 3, wherein each said tie bracket which is adjacent to said proximal end of said first insulating panel is vertically longitudinally oriented, and has a vertical center line spaced apart from said proximal end of said first insulating panel by a distance interval of six inches, and each said tie bracket being a unitary structure having flat plates on either end, connecting and spacing apart said first insulating panel and said second insulating panel and spanning a space therebetween, and said flat plates being embedded in and extending the full height of said first and second insulating panels.

5. The insulating concrete form according to claim 4, wherein said distance interval by which said vertical center line of each tie bracket is spaced apart from each adjacent tie bracket is a whole number multiple of measurements of one foot.

6. The insulating concrete form according to claim 1, wherein said at least one tie bracket includes a plurality of tie brackets, each having a vertical center line, wherein the vertical center line of each said tie bracket is spaced apart from the vertical center line of every adjacent said tie bracket by a distance interval which is a whole number multiple of measurements of one foot, and each said tie bracket being a unitary structure having flat plates on either end, connecting and spacing apart said first insulating panel and said second insulating panel and spanning a space therebetween, and said flat plates being embedded in and extending the full height of said first and second insulating panels.

7. The insulating concrete form according to claim 1, wherein each said interlocking member has a center which is spaced apart from the center of each adjacent said interlocking member by a distance of one foot.

8. The insulating concrete form according to claim 1, wherein each said interlocking member is greater in length than one inch.

9. The insulating concrete form according to claim 1, wherein said first insulating panel and said second insulating panel both are straight, whereby said insulating concrete form is a straight insulating concrete form.

10. The insulating concrete form according to claim 1, wherein said first insulating panel and said second insulating panel each include a long leg and a short leg, each said short leg disposed at an angle to each said long leg, and together forming a unitary panel, whereby said insulating concrete form is a corner insulating concrete form.

11. The insulating concrete form according to claim 10, wherein said long leg and said short leg of said first insulating panel form an outside corner, the long leg being thirty inches and said short leg being eighteen inches such that the combined lengths of said long leg and said short leg have a sum total length of four feet.

12. An insulating concrete form for receiving poured concrete, comprising:

a first insulating panel formed from expanded foam, having a first interior surface, an upper surface, a lower surface, a proximal end, and a distal end;

a second insulting panel formed from expanded foam, having a second interior surface facing said first interior surface of said first insulating panel, an upper surface a lower surface, a proximal end, and a distal end; and a plurality of tie brackets spanning, connecting, and spacing apart said first insulating panel and said second insulating panel, wherein each said tie bracket is vertically longitudinally oriented and has a vertical center line, and wherein one said tie bracket is adjacent to said proximal end of said first insulating panel, and said vertical center line of said tie bracket adjacent to said proximal end is spaced apart from said proximal end by a distance interval of six inches, and said vertical center line of each said tie bracket is spaced apart from said vertical center line of every adjacent said tie bracket by a distance interval of one foot, wherein said first interior surface and said second interior surface each comprise a series of male extensions protruding therefrom to thereby form a void between said first interior surface and said second interior surface such that a plurality of spaced apart posts, a plurality of spaced apart beams disposed to intersect said posts, and a plurality of webs spanning and joining adjacent said posts and adjacent said beams are formed when said void is filled with poured concrete and the concrete cures, and wherein said upper surface of first insulating panel has a male interlocking member formed therein and said lower surface of said first insulating panel has a female interlocking member formed therein, wherein said male interlocking member and said female interlocking member are disposed to oppose parallel movement of one said insulating concrete form with respect to a second said insulating concrete form disposed in stacked, interlocked relationship therewith, and wherein the upper surface of said first and second insulating panel have a series of male projections formed along the interior surfaces of said first male interlocking member, and wherein each said male projection has a center which is spaced apart from the center of each adjacent said interlocking member by a distance of one foot, a first said male projection located closest to said proximal end of each of said insulating panels and a second said male projection located closest to said distal end of said insulating panels having a first predetermined length, and each of the remaining male projections located between said first and second said male projections having a second predetermined length, said second predetermined length being double the first predetermined length, and the lower surface of said first and second insulating panels have a series of corresponding female notches formed therein for mating coupling between said male projections and said female notches for vertical alignment between said concrete forms to prohibit horizontal and vertical displacement, and wherein the series of protrusions of said first and second interior surfaces face one another in an opposing manner such that said posts and said beams are parallelepiped joined where said posts and said beams intersect one another, and wherein said posts have exterior surfaces disposed parallel to said first insulating panel and said second insulating panel.

13. The insulating concrete form according to claim 12, wherein said first insulating panel and said second insulating panel both are straight, whereby said insulating concrete form is a straight insulating concrete form.

14. The insulating concrete form according to claim 12, wherein said first insulating panel and said second insulating panel each include a long leg and a short leg, each said short leg disposed at an oblique angle to each said long leg, and together forming a unitary panel, whereby said insulating concrete form is a corner insulating concrete form.

15. The insulating concrete form according to claim 14, wherein said long leg and said short leg of said first insulating panel form an outside corner, the long leg being thirty inches and said short leg being eighteen inches, such that the combined lengths of said long leg and said short leg have a sum total length of four feet.

16. An insulating concrete form for receiving poured concrete, comprising:

a first insulating panel formed from expanded foam, having a first interior surface, an upper surface, a lower surface, a proximal end, and a distal end;

a second insulating panel formed from expanded foam, having a second interior surface facing said first interior surface of said first insulating panel, an upper surface, a lower surface, a proximal end, and a distal end; and at least one tie bracket spanning, connecting, and spacing apart said first insulating panel and said second insulating panel, wherein said first interior surface and said second interior surface have principally flat surfaces comprising a series of male extensions protruding therefrom collectively to thereby form a void between said first interior surface and said second interior surface such that a plurality of spaced apart posts, a plurality of spaced apart beams disposed to intersect said posts, and a plurality of webs spanning and joining adjacent said posts and adjacent said beams are formed when said void is filled with poured concrete and the concrete cures, and wherein said upper surface of said first insulating panel has a first interlocking member formed therein and said lower surface of said first insulating panel has a second interlocking member formed therein, wherein said first interlocking member and said second interlocking member are disposed to oppose parallel movement of one said insulating concrete form with respect to a second said insulating concrete form disposed in stacked, interlocked relationship therewith, and wherein said first interlocking member is a male interlocking member and said second interlocking member is a female interlocking member, wherein each said female interlocking member is dimensioned and configured to receive one said male interlocking member in close cooperation therewith, and each said female interlocking member is located in vertical alignment with one said male interlocking member; and wherein the upper surface of said first and second insulating panels have a series of male projections formed along the interior surfaces of said first male interlocking member, said male projections being spaced from one another at intervals which are much longer than the length of the male projections themselves, thus providing a limited number of male projections spaced at relatively great distance from one another along the length of the upper surface of the panel, and the lower surface of said first and second insulating panels have a series of corresponding female notches formed therein for mating coupling between said male projections and said female notches for vertical alignment between said concrete forms to prohibit horizontal and vertical displacement and ensure vertical alignment of successive tie brackets during vertical alignment of said forms.

* * * * *